US006238237B1

(12) United States Patent
Nagahata et al.

(10) Patent No.: US 6,238,237 B1
(45) Date of Patent: May 29, 2001

(54) CONNECTOR

(75) Inventors: Takaya Nagahata; Tokihiko Kishimoto, both of Kyoto; Koichi Wada; Shigemitsu Suzuki, both of Yamagata, all of (JP)

(73) Assignees: Rohm Co., Ltd., Kyoto; Jae Yamagata Ltd., Yamagata, both of (JP)

( * ) Notice: Subject to any disclaimer, the term of this patent is extended or adjusted under 35 U.S.C. 154(b) by 0 days.

(21) Appl. No.: 09/381,052

(22) PCT Filed: Mar. 18, 1998

(86) PCT No.: PCT/JP98/01140

§ 371 Date: Sep. 13, 1999

§ 102(e) Date: Sep. 13, 1999

(87) PCT Pub. No.: WO98/42044

PCT Pub. Date: Sep. 24, 1998

(30) Foreign Application Priority Data

Mar. 18, 1997 (JP) ..... 9-064483

(51) Int. Cl.[7] ..... H04R 12/24
(52) U.S. Cl. ..... 439/493; 439/629
(58) Field of Search ..... 439/493, 499, 439/67, 77, 74, 65, 629, 62, 59, 78, 79, 492, 630, 631

(56) References Cited

U.S. PATENT DOCUMENTS 3,697,926 * 10/1972 Krafthefer ..... 439/75
3,706,954 * 12/1972 Krafthefer ..... 439/65
4,150,863 * 4/1979 Krafthefer et al. ..... 439/748
4,550,959 * 11/1985 Grabbe et al. ..... 439/33
4,629,278 * 12/1986 Norton et al. ..... 439/570
4,738,625 * 4/1988 Burton et al. ..... 439/59
5,009,605 * 4/1991 Crumley et al. ..... 439/67
5,460,546 * 10/1995 Kunishi et al. ..... 439/631
5,944,536 * 8/1999 Seong et al. ..... 439/79

FOREIGN PATENT DOCUMENTS 54-12885 1/1979 (JP) .
55-11087 3/1980 (JP) .
64-40176 3/1989 (JP) .
1-129875 9/1989 (JP) .
3-280368 12/1991 (JP) .
8-37048 2/1996 (JP) .
8-45582 2/1996 (JP) .
6-77168 10/1999 (JP) .

* cited by examiner

*Primary Examiner*—Paula Bradley
*Assistant Examiner*—Ross Gushi
(74) *Attorney, Agent, or Firm*—Merchant & Gould P.C.

(57) ABSTRACT

A connector (1) according to the present invention includes a housing (2) and terminal pins (3) mounted on the housing (2) for electrically connecting connection terminals (16) of a circuit board (15) to a conductor pattern of a flat cable (11). The housing (2) is bonded to the circuit board (15) by an adhesive for mechanical connection thereto. The housing (2) has a projection (5) which, together with the circuit board (15), forms a recess (17) for applying an adhesive thereto.

11 Claims, 5 Drawing Sheets

CONNECTOR

TECHNICAL FIELD

The present invention relates to a connector having a housing and terminal pins mounted on the housing for electrically connecting connection terminals of a circuit board to a counterpart conductor pattern wherein the housing is bonded to the circuit board by the use of an adhesive for mechanical connection thereto.

BACKGROUND OF THE INVENTION

Conventionally, a circuit board and a housing of a connector are bonded by an adhesive as shown in FIGS. 8A and 8B. Specifically, a housing 32 of a connector 31 has a plurality of terminal pins 33 projecting therefrom. The terminal pins are inserted into through-holes formed in a circuit board 34 at portions corresponding to a plurality of connection terminals 35. After the circuit board 34 and the housing 32 are precisely aligned, an adhesive having a relatively high viscosity is applied between the circuit board 34 and the housing 32 by the use of an expensive coating equipment such as a dispenser.

In such a bonding method, however, the adhesive may flow into the housing 32, resulting in conduction failure between the terminal pins 33 and a conductor pattern of an object to be connected such as a flat cable. Further, a spring member for sandwiching the object between itself and the housing 32 may be bonded to the housing so that the object is hindered from being inserted therebetween. Moreover, since the adhesive is applied between the housing 32 and the circuit board 34, problems are likely to be occur that the position of the circuit board 34 relative to the housing 32 is shifted or that the circuit board 34 rises from the housing 32. If the adhesive to be applied is reduced in amount to solve these problems, the mechanical strength of the connection becomes insufficient, resulting in the release of the connector 31 from the circuit board 34.

These problems have not yet been solved even by the use of an adhesive having a relatively high viscosity and by the use of an expensive coating equipment such as a dispenser for applying an appropriate amount of an adhesive.

DISCLOSURE OF THE INVENTION

Therefore, it is an object of the present invention to provide a connector which is capable of being bonded to a circuit board positively and strongly without using an expensive coating equipment, and which does not suffer from a conduction failure or a failure in mechanical connection with an object to be connected.

In accordance with a first aspect of the present invention, there is provided a connector comprising a housing and terminal pins mounted on the housing for electrically connecting connection terminals of a circuit board to a counterpart conductor pattern, the housing being bonded to the circuit board by an adhesive for mechanical connection thereto, characterized in that the housing is provided with a projection which, together with the circuit board, forms a recess for applying an adhesive thereto.

According to a preferred embodiment of the present invention, the projection comprises a linear body, a first bend extending generally perpendicularly from an end of the body, and a second bend extending from the other end of the body generally in the same direction as the first bend, the first and the second bends having end surfaces for coming into contact with an edge surface of the circuit board.

According to another preferred embodiment of the present invention, the housing may have an elastic member for clamping the circuit board between the elastic member and the housing.

According to a further preferred embodiment of the present invention, the elastic member comprises a first contact portion formed at an end of said said terminal pin for coming into contact with the connection terminal of the circuit board.

According to another preferred embodiment of the present invention, the other end of each said terminal pin is formed with a second contact portion for coming into contact with the counterpart conductor pattern to clamp the counterpart between the second contact portion and the housing under an elastic force.

According to another preferred embodiment of the present invention, the terminal pin may be held mounted to the housing by the elastic force of the second contact portion.

In accordance with a second aspect of the present invention, there is provided a connector comprising a housing and terminal pins mounted on the housing for electrically connecting connection terminals of a circuit board to a counterpart conductor pattern, the housing being bonded to the circuit board by an adhesive for mechanical connection thereto, characterized in that the housing is formed with a hole which, together with the circuit board, forms a recess for applying an adhesive thereto.

According to a preferred embodiment, the hole extends through the housing, and an end of the hole is closed by a principal surface of the circuit board to form the recess.

According to another preferred embodiment, the hole is an elongated hole.

According to a further embodiment, the housing has a generally rectangular mounting surface to be mounted on the circuit board, and wherein the housing is provided with two holes one of which is provided at a longitudinal end of the generally rectangular mounting surface, the other hole being provided at the other longitudinal end of the generally rectangular mounting surface.

In accordance with a third aspect of the present invention, there is provided a connector comprising a housing and terminal pins mounted on the housing for electrically connecting connection terminals of a circuit board to a counterpart conductor pattern, the housing being bonded to the circuit board by an adhesive for mechanical connection thereto, characterized in that the housing is provided with a projection which, together with the circuit board, forms a recess for applying an adhesive thereto, and a hole which, together with the circuit board, forms a recess for applying an adhesive thereto. various features and advantages of the present invention will become clearer from the description given below with reference to the accompanying drawings.

BEST MODE FOR CARRYING OUT THE INVENTION

A preferred embodiment of the present invention will be now described with reference to FIGS. 1 to 7.

Figure 1:
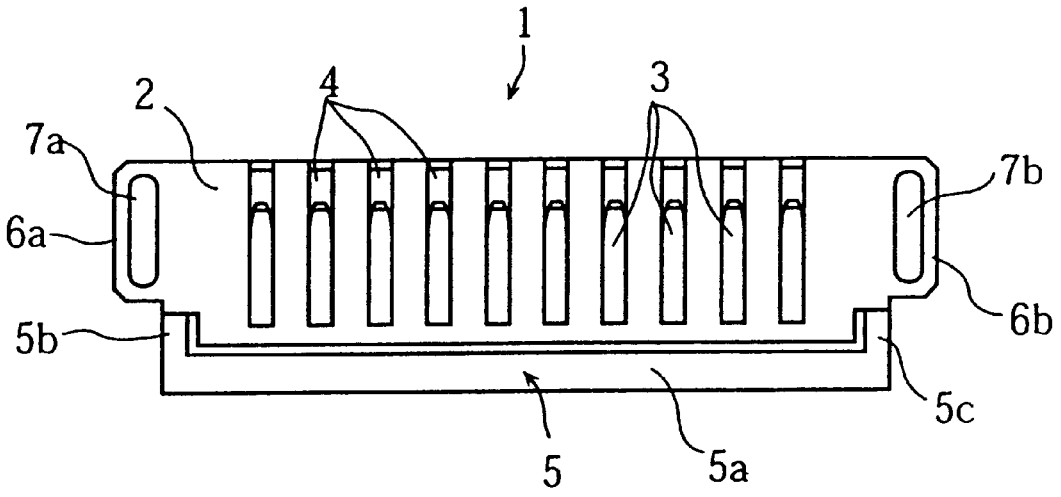
FIG. 1 is a plan view showing a connector embodying the present invention.
Figure 2:
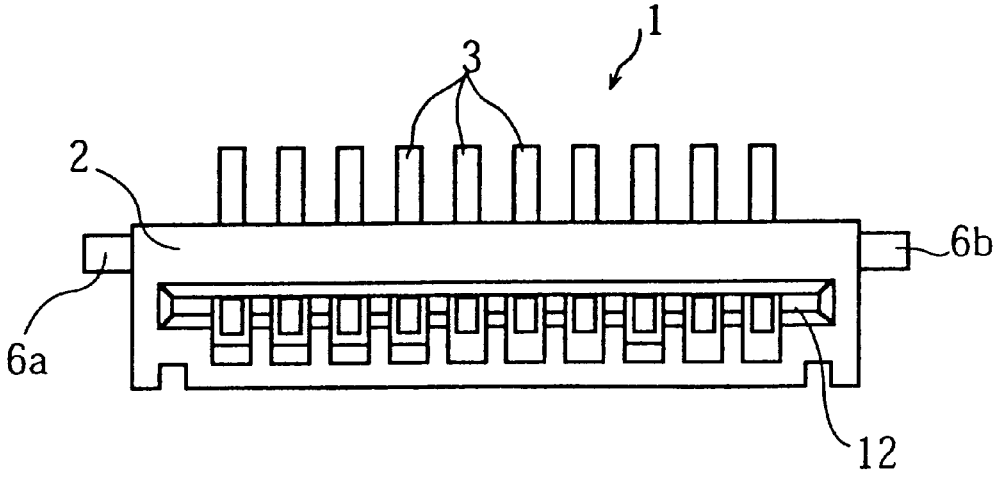
FIG. 2 is a front view showing the connector embodying the present invention.

FIG. 1 is a plan view showing a connector embodying the present invention. FIG. 2 is a front view showing the connector. The connector 1 has a housing 2 and a plurality of terminal pins 3. The upper surface of the housing 2 which is generally rectangular is formed, at a predetermined pitch, with a plurality of grooves 4 extending widthwise of the housing for inserting the terminal pins 3. The upper surface of the housing 2 is also provided, on one widthwise side, with a longitudinally extending projection 5. The projection 5 comprises a linear body 5*a*, a first bend 5*b* extending generally perpendicularly from an end of the body 5*a*, and a second bend 5*c* extending from the other end of the body 5*a* generally in the same direction as the first bend 5*b*.

One longitudinal end of the housing 2 is provided with a projection 6*a*. The projection 6*a* has an upper surface which is flush with the upper surface of the housing 2. The projection 6*a* is formed with an elongated hole 7*a* extending through the projection 6*a*. The other longitudinal end of the housing 2 is provided with a projection 6*b*. The projection 6*b* has an upper surface which is flush with the upper surface of the housing 2. The projection 6*b* is formed with an elongated hole 7*b* extending through the projection 6*b*.

Figure 5:
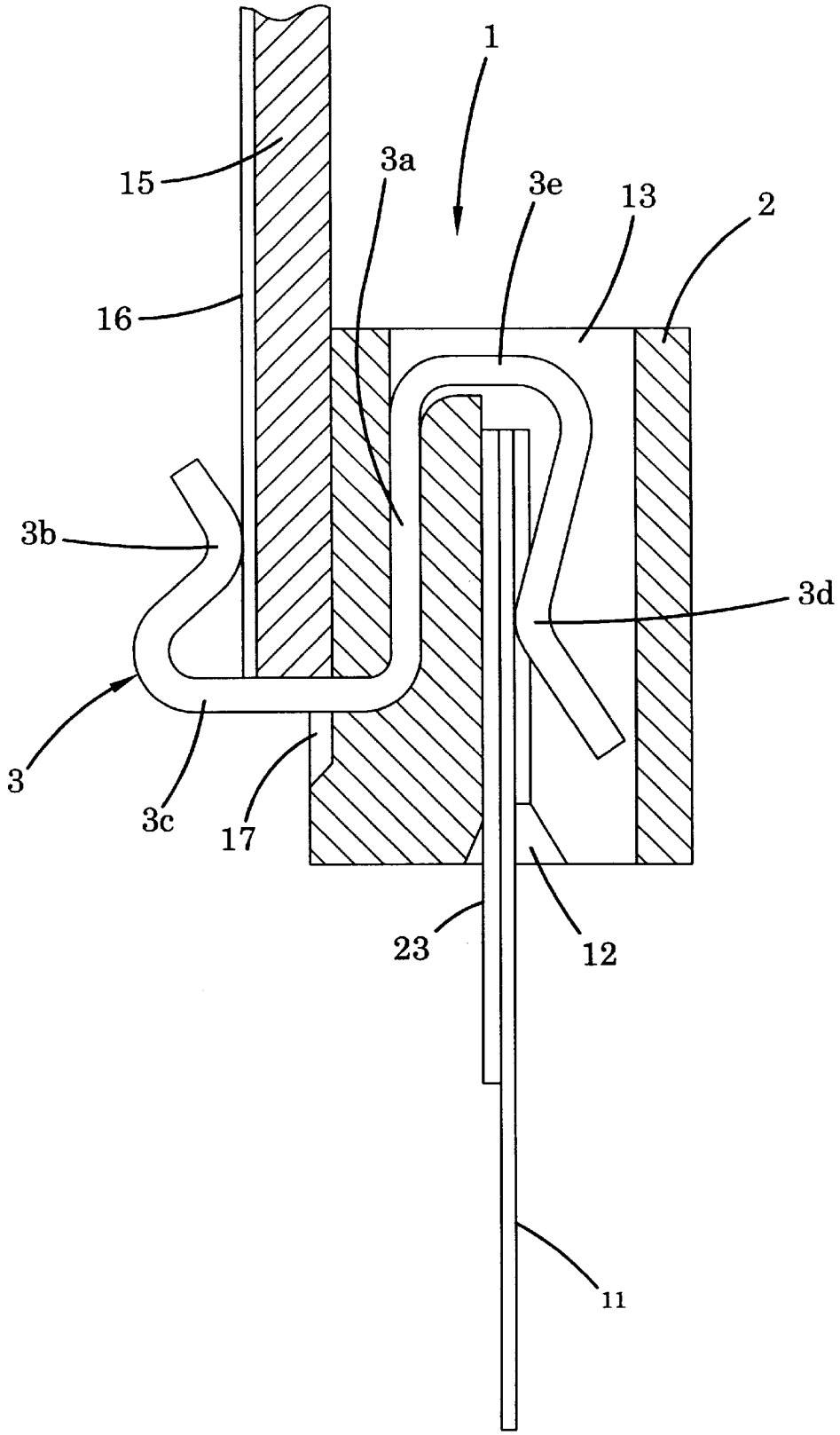
FIG. 5 is a sectional view taken along lines V—V in FIG. 3.
Figure 7:
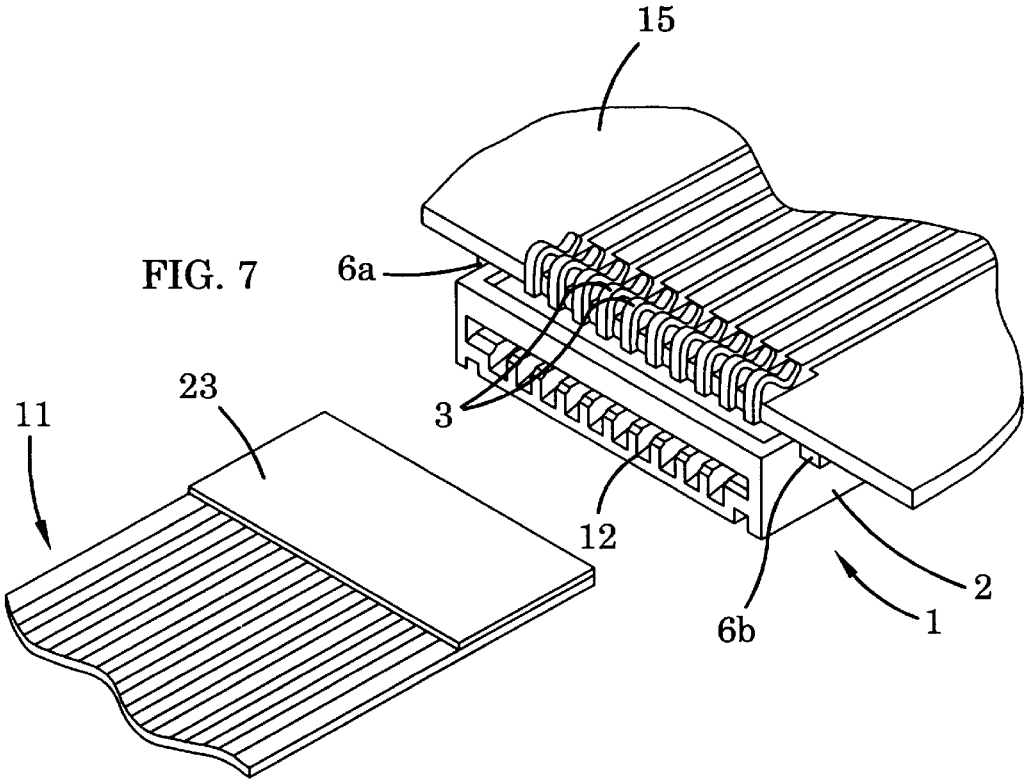
FIG. 7 is a perspective view showing the connector embodying the present invention before inserting an object to be connected.
Figure 8A:
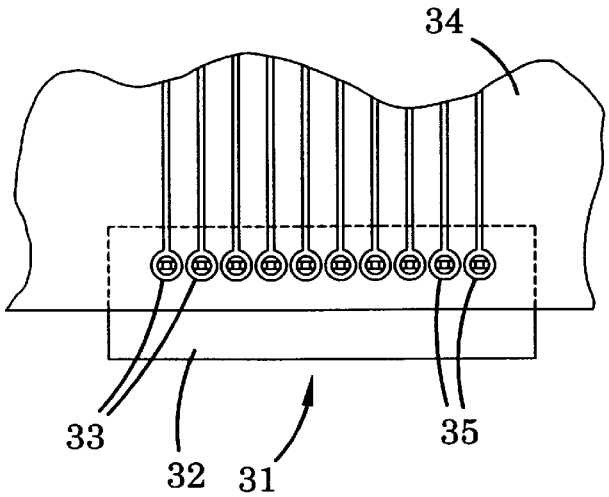
FIG. 8A (Prior Art)
FIG. 8A is a plan view showing a prior art connector mounted to a circuit board.
Figure 8B:
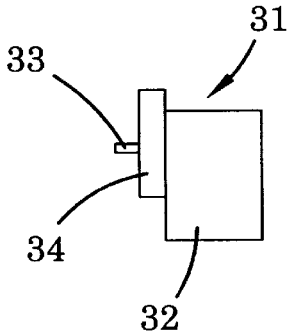
FIG. 8B (Prior Art)
FIG. 8B is a side view showing the prior art connector mounted to the circuit board.

The housing 2 is provided with a forwardly open mouth 12 for inserting a flat cable 11 as an object to be connected, as shown in FIG. 7. The housing 2 is also provided with a backwardly open mouth 13 for inserting the terminal pins 3, as shown in FIG. 5. The mouth 12 communicates with the mouth 13.

As shown in FIG. 5, each terminal pin 3 comprises a linear holding portion 3*a*, a first contact portion 3*b* for coming into contact with a respective connection terminal 16 provided on a principal surface 15*a* of a circuit board 15, a first joint 3*c* for joining an end of the holding portion 3*a* to the first contact portion 3*b*, a second contact portion 3*d* for coming into contact with a conductor pattern of the flat cable 11, and a second joint 3*e* for joining the other end of the holding portion 3*a* to the second contact portion 3*d*. The terminal pin 3 is formed of a metal, and each of the first and second contact portions 3*b* and 3*d* constitutes a spring. The first contact portion 3*b* compresses the circuit board 15 against the housing 2, whereas the second contact portion 3*d* compresses the flat cable 11 against the housing 2. Where the flat cable 11 is not inserted in the mouth 12 of the housing 2, the terminal pin 3 is fixed to the housing 2 due to the fact that the second contact portion 3*d* and the holding portion 3*a* of the terminal pin 3 clamps the housing 2.

Figure 3:
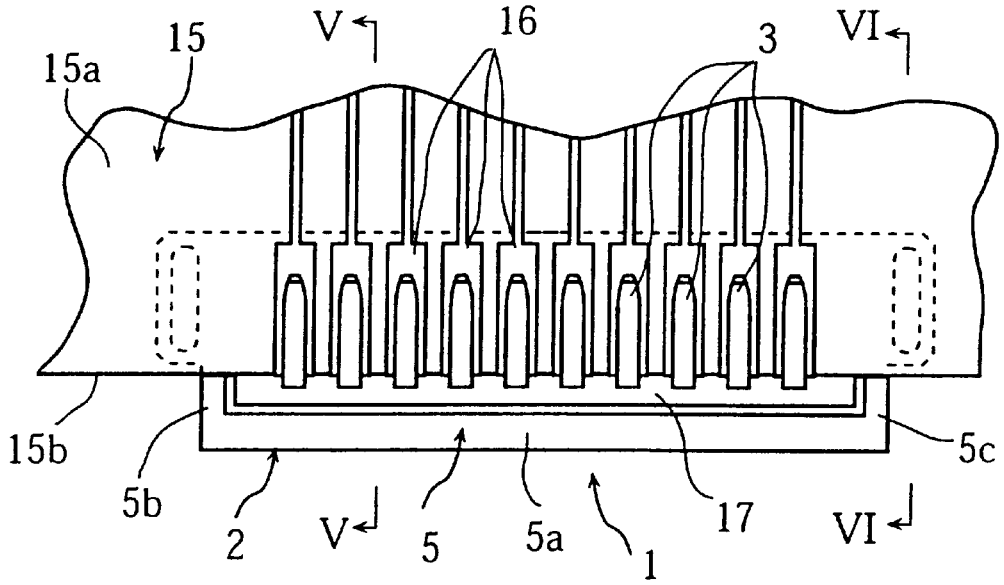
FIG. 3 is a plan view showing the connector embodying the present invention with the connector mounted to a circuit board.
Figure 4:
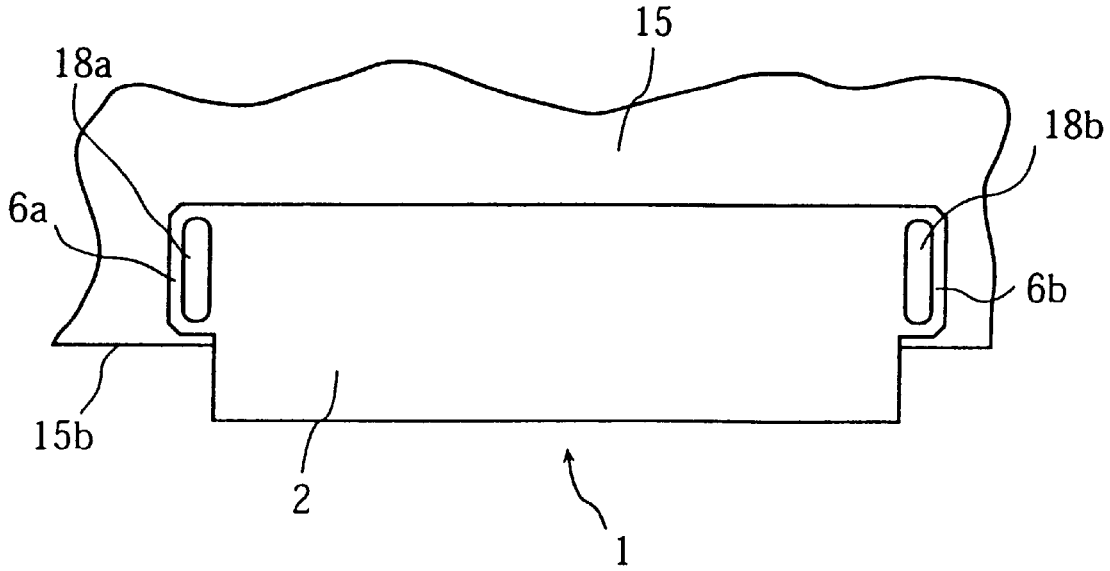
FIG. 4 is a bottom view showing the connector embodying the present invention with the connector is mounted to the circuit board.
Figure 6:
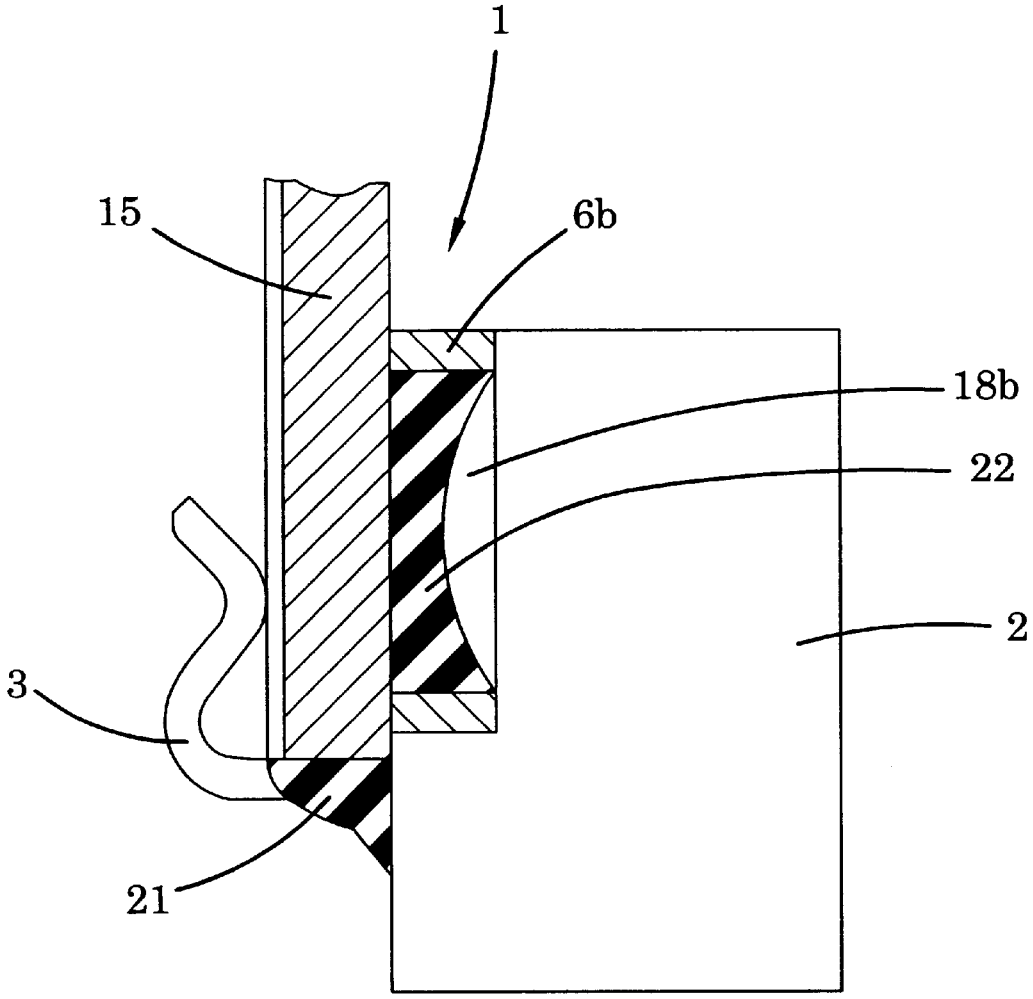
FIG. 6 is a sectional view taken along lines VI—VI in FIG. 3.

In bonding the connector 1 to the circuit board 15, the circuit board 15 is positioned to align each connection terminal 16 with a corresponding terminal pin 3 of the connector 1. The circuit board 15 is then inserted so as to urge the first contact portion 3*b* of the terminal pin 3 outwardly until an edge surface 15*b* of the circuit board 15 comes into abutment with the end surfaces of the bends 5*b*, 5*c* of the projection 5 on the upper surface of the housing 2, as shown in FIGS. 3 and 4. In this state, the circuit board 15 is pressed against the housing 2 by the first contact portion 3*b* of the terminal pin 3, whereby the connector 1 is provisionally fixed to the circuit board 15. By thus mounting the connector 1 to the circuit board 15, a recess 17 is defined by the projection 5 of the housing 2 and the circuit board 15, whereas recesses 18*a*, 18*b* are defined by the peripheral walls of the elongated holes 7*a*, 7*b* of the projections 6*a*, 6*b* of the housing 2 and the circuit board 15. As shown in FIG. 6, adhesive deposits 21, 22 containing a resin for example are loaded in the recesses 17, 18*a*, 18*b* for solidification to mechanically connect the connector 1 to the circuit board 15 in a firm state.

After the solidification of the adhesive deposits 21, 22, the flat cable 11 provided with a reinforcing member 23 as shown in FIG. 7 is inserted into the mouth 12 of the housing 2, so that the flat cable 11 is firmly held by the second contact portion 3*d* of the terminal pin 3. Thus, the conductor pattern of the flat cable 11 is electrically connected to a respective connection terminal 16 of the circuit board 15 through the terminal pin 3.

In this way, in fixing the connector 1 to the circuit board 15 according to the present embodiment, the adhesive 21, 22 is applied into the recesses 17, 18*a*, 18*b* which are defined when mounting the circuit board 15 to the housing 2. Accordingly, the adhesive 21, 22 is effectively prevented from flowing out regardless of its viscosity. As a result, it is possible to avoid a conduction failure due to the effluence of the adhesive between each connection terminal 16 of the circuit board 15 and the first contact portion 3*b* of the corresponding terminal pin 3 or between the conductor pattern of the flat cable 11 and the second contact portion 3*d* of the terminal pin 3. Further, the first contact portion 3*b* and the second contact portion 3*d* are prevented from being bonded to the housing by the adhesive 21, 22. Furthermore, since an appropriate amount of adhesive 21, 22 is retained in the recesses 17, 18*a*, 18*b*, the housing 2 and the circuit board 15 are bonded positively without using an expensive coating equipment. Moreover, it is also possible to avoid rising of the circuit board 15 from the housing 2 due to the adhesive 21, 22 between the circuit board 15 and the housing 2.

Since the circuit board 15 is clamped between the first contact portion 3*b* of the terminal pin 3 and the housing 2, the circuit board 15 is more effectively prevented from rising due to the adhesive 21, 22. Further, it is possible to keep the position of the circuit board 15 relative to the connector 1 in provisional fixation even after the solidification of the adhesive 21, 22.

Moreover, since the first contact portion 3*b* and the second contact portion 3*d* are integrally formed, each terminal pin 3 can be manufactured at a low cost and readily fixed to the housing 2.

Furthermore, since the edge surface 15*b* of the circuit board 15 is brought into contact with the end surfaces of the bends 5*b*, 5*c* of the projection 5, the circuit board 15 can be positioned accurately relative to the connector 1 with ease.

INDUSTRIAL APPLICABILITY

The connector according to the present invention may be utilized in a device for electrically connecting a circuit board to an object such as a flat cable.

What is claimed is:

1. A connector comprising:

terminal pins for electrically connecting connection terminals provided on a circuit board to a counterpart conductor pattern, and a housing having a main body for carrying the terminal pins, the main body of the housing being bonded to the circuit board by a deposit of adhesive and including a mounting surface confronting the circuit board, wherein the housing is provided with a first projection extending outwardly from the main body parallel to the mounting surface and formed with a hole which, together with the circuit board, forms a recess for receiving another deposit of adhesive for bonding to the circuit board, wherein the housing also is provided with an elastic member for clamping the circuit board between the elastic member and the housing, wherein the elastic member comprises a first contact portion formed at an end of each said terminal pin for coming into contact with the connection terminal of the circuit board, and wherein the other end of each said terminal pin is formed with a second contact portion for coming into contact with a counterpart conductor pattern to clamp the counterpart between the second contact portion and the housing under an elastic force.

2. The connector according to claim 1, wherein the hole extends through the first projection, the hole being closed at an end by the circuit board to form the recess.

3. The connector according to claim 1, wherein the hole is an elongated hole.

4. The connector according to claim 1, wherein the housing is further provided with a second projection extending outwardly from the main body in the opposite direction of the first projection and formed with a hole.

5. The connector according to claim 1, wherein each said terminal pin is held mounted to the housing by the elastic force of the second contact portion.

6. A connector comprising:

terminal pins for electrically connecting connection terminals provided on a principal surface of a circuit board to a counterpart conductor pattern, and a housing for carrying the terminal pins, the housing being bonded to the circuit board by an adhesive, wherein the housing is provided with a projection which, together with the circuit board, forms a recess for receiving the adhesive, the recess being positioned outwardly from the circuit board in a direction parallel to the principal surface of the circuit board, each of the terminal pins projecting out from the recess.

7. The connector according to claim 6, wherein the projection comprises a linear body, a first bend extending generally perpendicularly from an end of the body, and a second bend extending from the other end of the body generally in the same direction as the first bend, the first and the second bends having end surfaces for coming into contact with an edge surface of the circuit board.

8. The connector according to claim 7, wherein the housing is provided with an elastic member for clamping the circuit board between the elastic member and the housing.

9. The connector according to claim 8, wherein the elastic member comprises a first contact portion formed at an end of each said terminal pin for coming into contact with the connection terminal of the circuit board.

10. The connector according to claim 9, wherein the other end of each said terminal pin is formed with a second contact portion for coming into contact with the counterpart conductor pattern to clamp the counterpart between the second contact portion and the housing under an elastic force.

11. The connector according to claim 10, wherein each said terminal pin is held mounted to the housing by the elastic force of the second contact portion.

* * * * *